US006773133B2

(12) United States Patent
Lee

(10) Patent No.: US 6,773,133 B2
(45) Date of Patent: Aug. 10, 2004

(54) TOUCH-AND-FLASH DECORATIVE ARTICLE

(76) Inventor: Ching-Hui Lee, P.O. Box 590, Taichung City, Taichung (TW), 400

( * ) Notice: Subject to any disclaimer, the term of this patent is extended or adjusted under 35 U.S.C. 154(b) by 0 days.

(21) Appl. No.: 10/443,948

(22) Filed: May 23, 2003

(65) Prior Publication Data

US 2004/0105254 A1 Jun. 3, 2004

(30) Foreign Application Priority Data

Dec. 2, 2002 (CN) ..... 02249957 U

(51) Int. Cl.[7] ..... F21L 4/04

(52) U.S. Cl. ..... 362/121; 362/186; 362/103; 362/191; 362/398; 362/807

(58) Field of Search ..... 362/198, 200, 362/201, 203, 116, 103, 121, 186, 191, 202, 398, 806, 807

(56) References Cited

U.S. PATENT DOCUMENTS 6,296,367 B1 * 10/2001 Parsons et al. ..... 362/183

2004/0032734 A1 * 2/2004 Chen ..... 362/189

* cited by examiner

*Primary Examiner*—Alan Cariaso
*Assistant Examiner*—Mark Tsidulko

(57) ABSTRACT

A touch-and-flash decorative article, comprising of an upper hollow pipe, a lower hollow pipe and an exterior magnet. On the top rim of the upper hollow pipe are two symmetrically positioned insert pins and a circuit board that is connected via the insert pins to the upper hollow pipe. On the circuit board are an IC and LED, a transistor and a resistor. On the lower side of the circuit board are two ring-shaped copper wires. Inside the lower hollow pipe is a ring of insulating paper. At the center of bottom inside the lower hollow pipe is a jut. On the bottom inside the lower hollow pipe is a round magnet with a round hole at its center. The round hole penetrates through the jut. The magnet has a ring-shaped insulating washer. Inside the hollow of the lower hollow pipe are one to two batteries. The upper and lower hollow pipes are joined together by screwing the exterior pipe thread with interior pipe thread. The exterior magnet is independently installed outside the upper and lower hollow pipes. By touching the lower side of the circuit board or screwing the upper and lower hollow pipes together, the LED lamp is switched on. The product is compact to carry and easy to use.

3 Claims, 4 Drawing Sheets

TOUCH-AND-FLASH DECORATIVE ARTICLE

BACKGROUND OF THE INVENTION

1. Field of the Invention

The present invention relates to a touch-and-flash decorative article.

2. Description of the Prior Art

Most conventional decorative articles are without flashing light and lack of amusement effect. Though a few decorative articles may have light flashing function, they will not function until they are switched on. Therefore, the additional switch mechanism complicated the construction of the product.

BRIEF DESCRIPTION OF THE INVENTION

The present invention comprises an upper hollow pipe, a lower hollow pipe and an exterior magnet. On the rim of the top of the upper hollow pipe are two symmetrically positioned insert pins and a circuit board that is connected via the insert pins to the upper hollow pipe. On the circuit board are Integrated Circuit (IC), Light Emitting Diode (LED), transistor and resistor. The upper side of the circuit board is coated with a layer of transparent glue. On the lower side of the circuit board are two ring-shaped copper wires. Inside the upper hollow pipe is an interior pipe thread. Inside the lower hollow pipe is a ring of insulating paper. At an upper part of the lower hollow pipe is an exterior pipe thread. At the center of the bottom inside the lower hollow pipe is a jut. On the bottom of the lower hollow pipe is a round magnet with a round hole at its center. The round hole on the round magnet penetrates the jut. On the round magnet is a ring-shaped insulating washer. Inside the hollow of the upper and lower hollow pipes are one to two batteries. The upper and lower hollow pipes are joined together by screwing the exterior pipe thread with the interior pipe thread. The exterior magnet is independently installed outside of the upper and lower hollow pipes.

In applications, the shape of the circuit board is optionally a circle, a square, a heart or a star. On the top of the circuit board is a round hole. Optionally, there is a transparent plastic unit or glass unit outside the circuit board for tight assembly with the upper hollow pipe. The exterior magnet outside the upper and lower hollow pipes is optionally replaced by an opened metal ring that is attached to the bottom of the lower hollow pipe, thereby forming the shape of a bracelet.

Due to the variability of the shape of the circuit board and the LED installed on the circuit board, the present invention of touch-and-flash decorative article has the effect of fin and amusement. Besides, tightening of the upper hollow pipe with the lower hollow pipe activates the circuit board, which in turn turns on the LED. Or, by touching the ring-shaped copper foil wires on the lower side of the circuit board, the IC is activated to turn on the LED. This function serves as a switch, enabling compact construction and convenient use of the present invention.

DETAILED DESCRIPTION OF PREFERRED EMBODIMENTS

Figure 1:
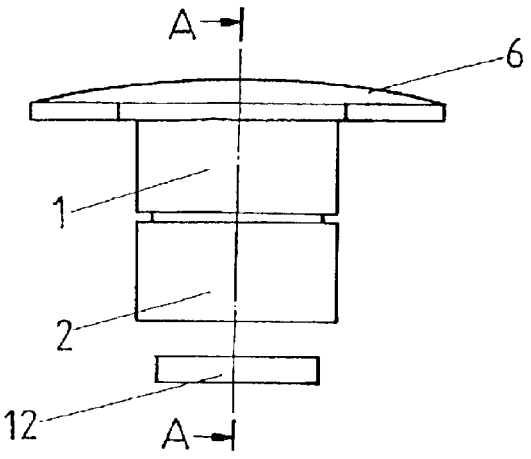
FIG. 1 is a side view of the invention.
Figure 2:
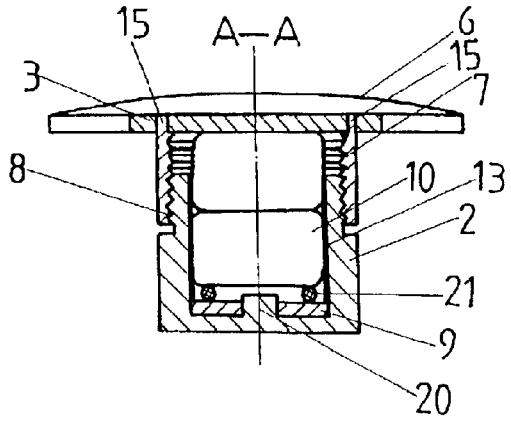
FIG. 2 is a section view taken from A—A of FIG. 1 without the exterior magnet.
Figure 3:
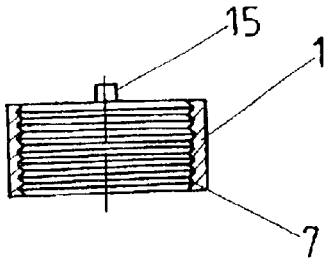
FIG. 3 is a side view of the upper hollow pipe in the invention.
Figure 4:
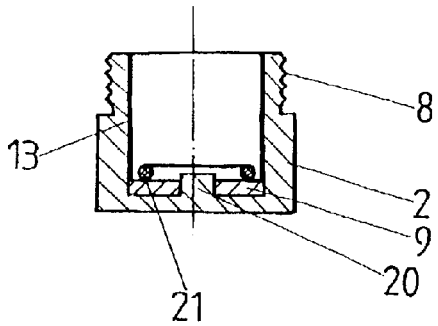
FIG. 4 is a side view of the lower hollow pipe in the invention.
Figure 5:
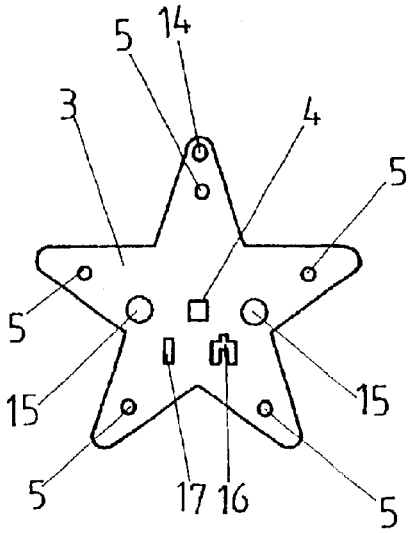
FIG. 5 is a front view of a star-shaped circuit board in the invention.

As shown in FIGS. 1 through 4, the present invention comprises an upper hollow pipe 1, a lower hollow pipe 2 and an exterior magnet 12. On the rim of the top of the upper hollow pipe 1 are two symmetrically positioned insert pins 15 and a circuit board 3 that is connected via the two insert pins 15 to the upper hollow pipe 1. On the circuit board 3 are an IC 4 and an LED 5, a transistor 6 and a resistor 7. The upper side of the circuit board 3 is coated with transparent glue 6. On the lower side of the circuit board 3 are two rings of copper foil wires 18, 19. Inside the upper hollow pipe 1 is an interior pipe thread 7. Inside the lower hollow pipe 2 is a ring of insulating paper 13. At the upper part of the lower hollow pipe 2 is an exterior pipe thread 8. At the center of the bottom inside the lower hollow pipe 2 is a jut 20. On the bottom inside the lower hollow pipe 2 is a round magnet 9 with a round hole at its center. The round hole on the round magnet 9 penetrates through the jut 20. The round magnet 9 has a ring-shaped insulating washer 21. Inside the hollow of the upper and lower hollow pipes 1 and 2 are two batteries 10. The upper and lower hollow pipes 1,2 are joined by screwing the exterior pipe thread 7 and the interior pipe thread 8. The exterior magnet 12 is independently installed on the outside of the upper and lower hollow pipes.

Figure 6:
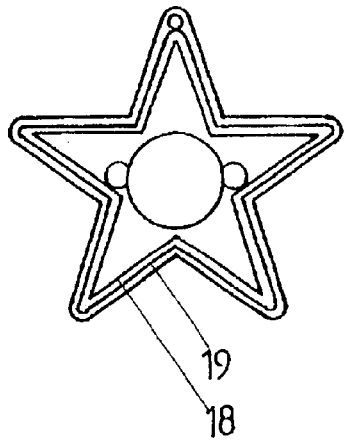
FIG. 6 is a rear view of a star-shaped circuit board in the invention.
Figure 8:
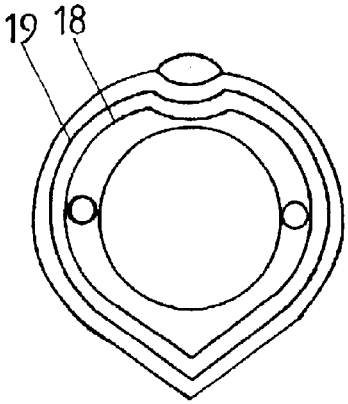
FIG. 8 is a rear view of a heart-shaped circuit board in the invention.
Figure 7:
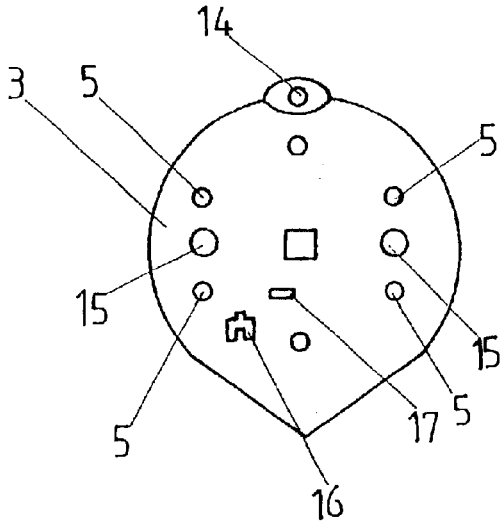
FIG. 7 is a front view of a heart-shaped circuit board in the invention.
Figure 9:
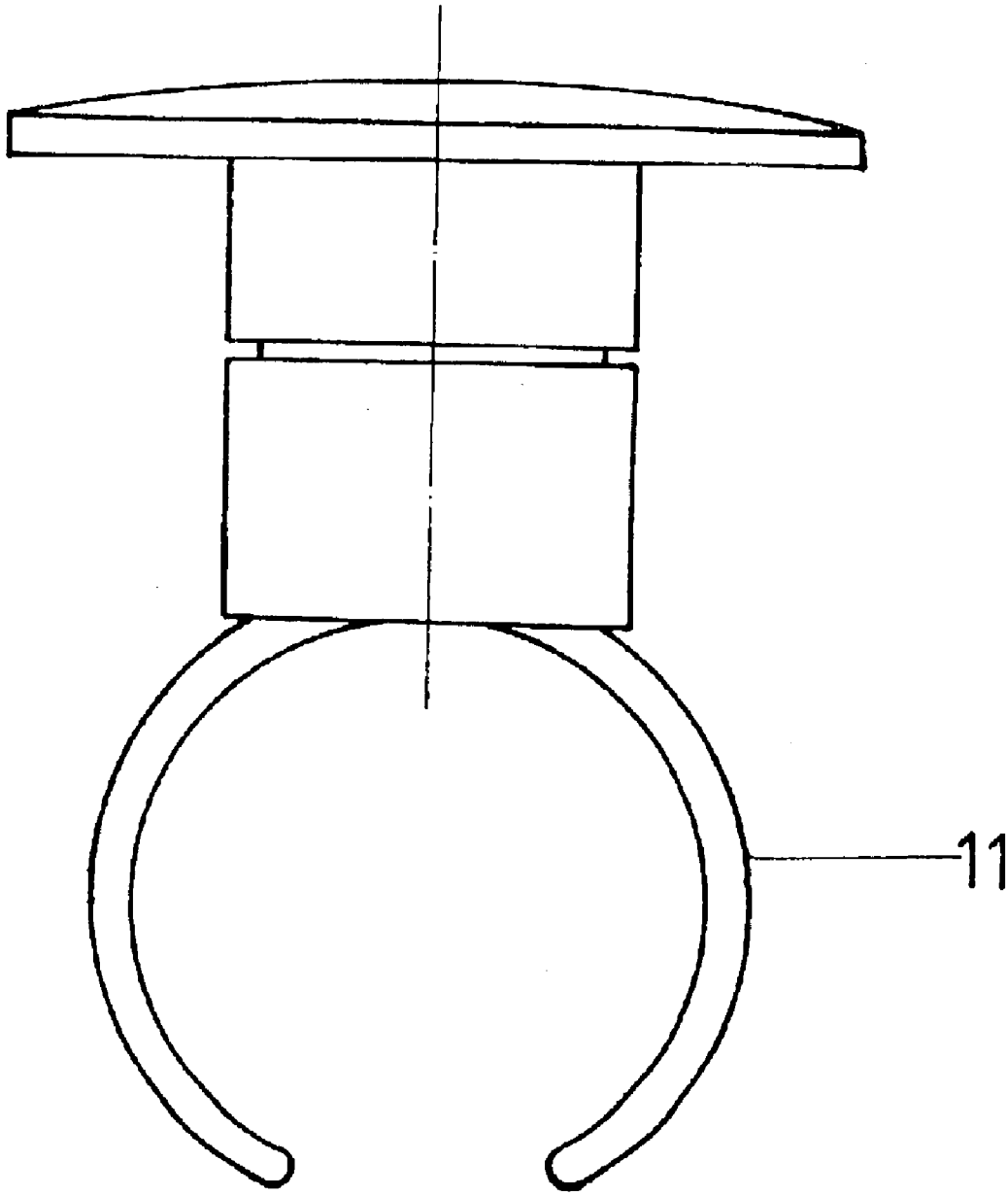
FIG. 9 is another embodiment view of the invention.
Figure 10:
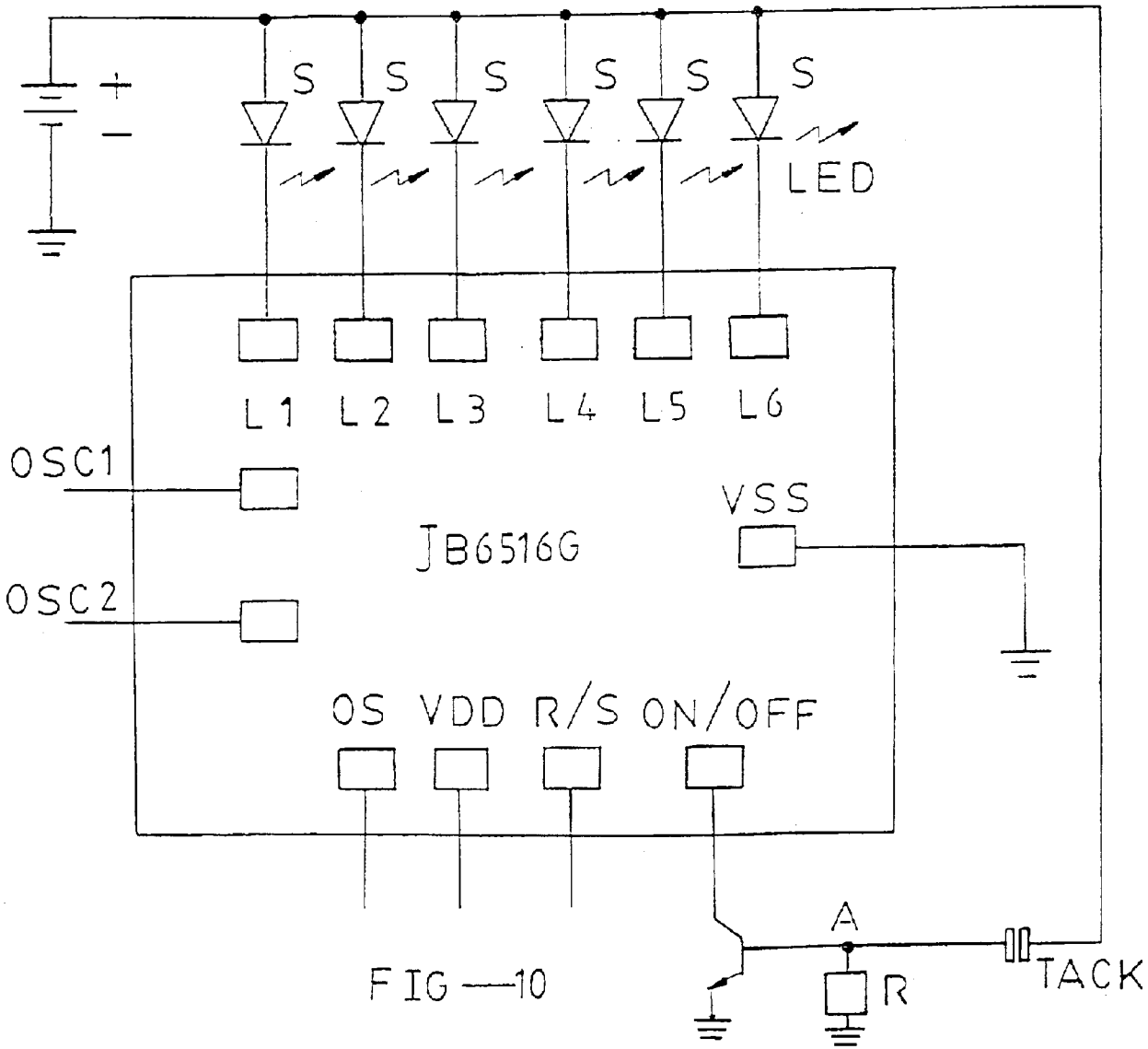
FIG. 10 is a wiring diagram of the invention.

As shown in FIGS. 5 through 10, the circuit board 3 is optionally shaped like a circle, a square, a heart and a star. When touched by hand, the ring-shaped copper foil wires 18, 19 on the bottom of the circuit board 3 are conducted, then the resistor 17 divides voltage, saturating the transistor 16. The IC 4 is subjected to a low pressure that serves to activate the switch and cause the LED 5 to flash. By touching the copper foil wires again by hand, the IC activated or disabled due to the divided pressure, and the LED is switched off. On the top of the circuit board 3 is a round hole 14. Optionally, there is a transparent plastic unit or glass unit on the outside of the circuit board 3 to join firmly with the upper hollow pipe 1. Optionally, the exterior magnet 12 outside the upper and lower hollow pipes 1, 2 is replaced by a metal ring 11 installed on the bottom of the lower hollow pipe 2 (as shown in FIG. 6), forming a ring shape.

What is claimed is:

1. A touch-and-flash decorative article, comprising an upper hollow pipe, a lower hollow pipe and an exterior magnet, on a rim of a top of said upper hollow pipe being two symmetrically positioned insert pins, and a circuit board that is connected via the insert pins to the upper hollow pipe, on said circuit board being IC, LED, transistor and resistor, the upper side of the circuit board being coated with a layer of transparent glue, on a lower side of the circuit board being two ring-shaped copper wires, inside the upper hollow pipe being an interior pipe thread, inside the lower hollow pipe being a ring of insulating paper, on an upper part of the lower hollow pipe being an exterior pipe thread, at a center of a bottom inside the lower hollow pipe being a jut, on a bottom inside the lower hollow pipe being a round magnet with a round hole at its center, the round hole on the round magnet penetrating through the jut, on the round magnet being a ring-shaped insulating washer, inside the hollow of the upper and lower pipes being one to two batteries, the upper and lower hollow pipes being joined by screwing the exterior pipe thread with the interior pipe thread, the exterior magnet being independently installed outside of the upper and lower hollow pipes.

2. The touch-and-flash decorative article of claim 1, characterized in that, the circuit board is optionally shaped like a circle, a square, a heart or a star, there being a round hole on a top of the circuit board, and optionally there is a transparent plastic unit or a glass unit outside the circuit board for tight fastening purpose to the upper hollow pipe.

3. The touch-and-flash decorative article of claim 1, characterized in that, the exterior magnet outside the upper and lower hollow pipes could be optionally replaced by a opened metal ring attached to the bottom of the lower hollow pipe, thereby forming a shape of a bracelet.

* * * * *